United States Patent [19]

Yamagata et al.

[11] Patent Number: 4,559,423

[45] Date of Patent: Dec. 17, 1985

[54] CIRCUIT INTERRUPTER

[75] Inventors: Shinji Yamagata; Shigemi Tamaru; Hiroshi Fujii, all of Fukuyama; Hideo Suhara, Hiroshima; Fumiyuki Hisatsune, Fukuyama; Setsuo Hosogai, Fukuyama; Kiyomi Yamamoto, Fukuyama, all of Japan

[73] Assignee: Mitsubishi Denki Kabushiki Kaisha, Tokyo, Japan

[21] Appl. No.: 604,504

[22] Filed: Apr. 27, 1984

[30] Foreign Application Priority Data

| | | | |
|---|---|---|---|
| Apr. 28, 1983 | [JP] | Japan | 58-65224[U] |
| May 10, 1983 | [JP] | Japan | 58-82931 |
| May 11, 1983 | [JP] | Japan | 58-71283[U] |
| May 12, 1983 | [JP] | Japan | 58-84303 |

[51] Int. Cl.[4] ..... H01H 33/04

[52] U.S. Cl. ..... 200/144 R; 200/147 R

[58] Field of Search ..... 200/147 R, 148 C, 144 R

[56] References Cited

U.S. PATENT DOCUMENTS

| | | | |
|---|---|---|---|
| 2,292,158 | 8/1942 | Prince | 200/148 C |
| 2,988,622 | 6/1961 | Petermichl | 200/148 C |
| 3,506,799 | 4/1970 | Ellsworth et al. | 200/147 R |
| 3,617,667 | 11/1971 | Kirschner et al. | 200/148 C |
| 4,011,420 | 3/1977 | Heft | 200/147 R |
| 4,430,631 | 2/1984 | Forsell et al. | 200/147 R |

*Primary Examiner*—Robert S. Macon

*Attorney, Agent, or Firm*—Robert E. Burns; Emmanuel J. Lobato; Bruce L. Adams

[57] ABSTRACT

A circuit interrupter which comprises, in a compartment defined in an electrically insulating housing, a pair of separable contacts defining, when separated, an arcing region therebetween, and an operating mechanism, including a tripping unit and an operating handle, for opening and closing the separable contacts. The housing which includes an electrically insulating bottom wall has a gas exhaust passage having an inlet opening in the inner surface of the housing. The inlet of the gas exhaust passage is located in the bottom wall at a position effective for exhausting an arced gas generated in the arcing region without contacting the operating mechanism.

7 Claims, 11 Drawing Figures

CIRCUIT INTERRUPTER

BACKGROUND OF THE INVENTION

This invention relates to circuit interrupters, and more particularly to the exhausting of the arced gas from the molded case of a circuit interrupter.

A molded case circuit interrupter contains in a single molded housing separable contacts and an operating mechanism for actuating the contacts. It is known that an arced gas generates in the arcing region due to a high temperature electric arc drawn between separating contacts upon the interruption of an undesirable current flowing through a circuit interrupter. As is well known, since the arced gas is undesirable because of its high temperature, high pressure and because it contains ions and metal vapors, it should be exhausted from the housing as quickly as possible.

In order to quickly exhaust the arced gas from the housing, many circuit interrupters have an exhaust passage formed in the housing wall other than the bottom wall. One example of such a circuit interrupter is disclosed in Japanese Patent Laid-Open No. 57-180837 in which the arced gas generated in the arcing region between the separated contacts is exhausted through an exhaust passage formed in the cover section of the housing having perforated baffle plates after passing through a pressure-reducing space. This circuit interrupter, similarly to other conventional circuit interrupters, has its exhaust passage in the cover portion or the upper portion of the housing, and the single compartment defined by the housing wall for containing the contacts and the operating mechanism. Therefore, the arced gas generated in the arcing region travels through the single compartment in which the operating mechanism is disposed toward the gas exhaust passage. Since the arcing region and the operating mechanism are usually enclosed in a common single compartment defined by the housing, the arced gas flowing toward the exhaust passage inevitably diffuses toward the operating mechanism to contact with the metallic elements of the mechanism. When the metallic vapor entrained in the arced gas deposits on electrically insulating elements, such as a cross bar, of the operating mechanism, the dielectric strength of the insulating cross bar is degraded, raising the risk of short-circuiting between the poles. Also, when the metallic vapor deposits on the mechanical elements of the operating mechanism, the movement of the elements may be impeded, resulting in a failure of the current interruption. Further, since the outlet end of the gas exhaust passage opens upwardly in the top wall of the housing, the exhausted arced gas can reach the operating handle which is operated by a human hand. Also it is very desirable to have the dimensions of the gas exhaust passage vary according to the desired class of interrupter.

SUMMARY OF THE INVENTION

Accordingly, an object of the present invention is to provide a circuit interrupter in which the arced gas is exhausted away from the operating handle of the circuit interrupter to protect the operator from the arced gas.

Another object of the invention is to provide a circuit interrupter in which the arced gas is prevented from contacting the operating mechanism in the housing.

Still another object of the present invention is to provide a circuit interrupter in which the flow of the arced gas to be exhausted from the housing is directed away from the operating mechanism of the interrupter.

Still another object of the present invention is to provide a circuit interrupter in which the arced gas can be safely and effectively exhausted.

A further object of the present invention is to provide a circuit interrupter in which a gas exhaust passage can be easily formed.

A still further object of the present invention is to provide a circuit interrupter in which the dimension of the gas exhaust passage of the circuit interrupter can be easily changed.

With the above objects in view, the present invention resides in a circuit interrupter comprising, in an electrically insulating housing, a pair of separable contacts defining, when separated, an arcing region therebetween, and an operating mechanism, including a tripping unit and an operating handle, for opening and closing the separable contacts. The housing includes an electrically insulating bottom wall and has a gas exhaust passage having an inlet opening in the inner surface of the housing. The inlet of the gas exhaust passage is located in the bottom wall at a position effective for exhausting an arced gas generated in the arcing region without contacting the operating mechanism.

BRIEF DESCRIPTION OF THE DRAWINGS

The present invention will become more readily apparent from the following description of the preferred embodiments taken in conjunction with the accompanying drawings, in which.

DESCRIPTION OF THE PREFERRED EMBODIMENTS

Figure 1:
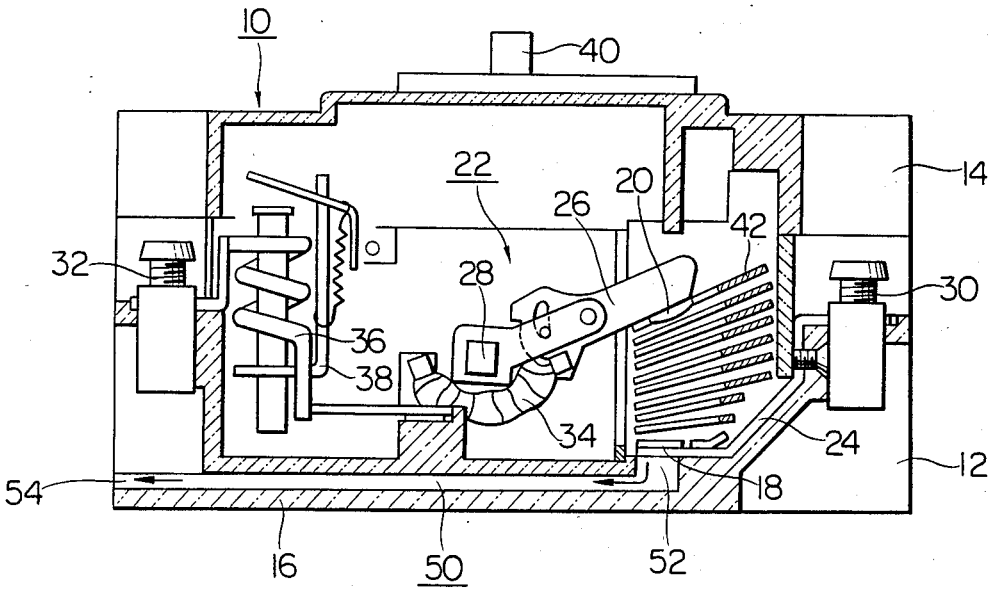
FIG. 1 is a sectional side view schematically illustrating the gas exhaust passage of a circuit interrupter of the present invention.

FIG. 1 illustrates a three pole circuit interrupter constructed in accordance with the present invention. The circuit interrupter comprises a housing 10 comprised of a main body 12 and a cover 14 both made of an electrically insulating material. The cover 14 includes side walls, end walls, a top wall and two partition walls, and the main body 12 includes side walls, end walls, a bottom wall 16 and two partition walls parallel to the side walls. The main body 12 and the cover 14 define, when assembled, three substantially closed compartments partitioned by the partition walls each for the respective poles of the circuit interrupter.

Within each of the pole compartments disposed are a pair of separable contacts 18 and 20 and an operating mechanism 22 for opening and closing the separable contact pair 18 and 20. The contact pair 18 and 20 may be of any conventional type, but are illustrated as including a stationary contact 18 mounted on the rigid conductor 24 secured on the inner surface of the bottom wall 16 of the housing 10, and a movable contact 20 carried on a movable contact arm 26 pivotally supported on an electrically insulating cross bar 28. The cross bar 28 extends through the partition walls into each of the three pole compartments so that the contact pair 18 and 20 in each pole unit simultaneously open or close. The stationary contact 18 is connected to a source side terminal 30 through the conductor 24. The movable contact 20 is connected to a load side terminal 32 through the movable contact arm 26, a flexible conductor 34, an electromagnetic coil 36 of the electromagnetic trip device and a bimetal element 38 of the thermally responsive trip device. As is well known in the art, an operating mechanism of the central pole unit includes, although not illustrated in the drawings, a releasable latch member released upon the actuation of the trip devices, a toggle mechanism for rotating the movable contact arm 26 in response to the movement of the latch member, and an operating handle 40 in addition to an operating mechanism composed of the electromagnetic and the thermally responsive trip devices 36 and 38 provided in the pole units on the both sides. Each of the three pole units includes an arc extinguisher 42 having a plurality of arc extinguishing plates known in the art.

According to the present invention, the bottom wall 16 of the housing 10 is provided with arced gas exhaust passages 50 each having inlet openings 52 formed in the inner surface of the bottom wall 16 and an outlet opening 54 formed in the outer surface of the bottom wall 16. The inlet openings 52 are formed in a position capable of effectively receiving and exhausting the arced gas generated in the arcing region upon current interruption. In the illustrated embodiment, the gas exhaust passage 50 for the respective pole units has two inlet openings 52 each positioned on the opposite sides of the stationary contact 18 and in the inner surface of the bottom wall 16 and extends in the thickness of the bottom wall 16 parallel to the inner and outer surfaces and terminates at a position below the load side terminal 32 which is remote from the source side terminal 30. The gas exhaust passages 50 may be integrally formed in the bottom wall 16 at the time of molding the main body 12 of the housing 10.

When an overcurrent flows through the circuit interrupter, the electromagnetic trip device 36 or the bimetallic thermal trip device 38 in that pole actuates to trip open the contact pair 18 and 20. The movement of the movable contact 20 in one pole unit is transmitted to other contact arms 26 in the remaining pole units, so that the actuation of any one of the pole units causes the simultaneous opening of the other sets of separable contacts 18 and 20. When the contacts 18 and 20 are thus separated, an electric arc is drawn between the separated contacts 18 and 20, and a high temperature and high pressure arced gas including ions and metallic particles is generated in the arcing region due to the very high temperature and high pressure of the arc. This arced gas should be exhausted from the interior of the housing 10 as quickly as possible because of its high temperature and high pressure and because it containes ions which degrade the dielectric strength of the interrupter. The electric arc generated between the contacts 18 and 20 is driven into the arc extinguisher 42 to be severed and cooled therein as is well known in the art. Since the arced gas exhaust passage 50, having the inlet opening 52 directly facing and close to the arcing region between the separated contacts 18 and 20, is provided in the bottom wall 16 of the housing 10 according to the present invention, the arced gas in the arcing region is immediately received in the inlet opening 52 of the gas exhaust passage 50 and exhausted through the outlet opening 54 at the remote end from the source side terminal 30. Therefore, the metallic particles do not deposit on the metallic elements of the operating mechanism and the movement of the mechanism is not impeded. Also, since the deposition of the metallic conductive particles is prevented, the dielectric strength of the cross bar 28 does not decrease even after repeated current interruptions. Further, the outlet opening 54 of the gas exhaust passage 50 is located below the load side terminal 32 remote from the source side terminal 32, so that the hot arced gas exhausted from the outlet opening 54 does not reach the operator's hand at the operating handle 40 and does not decrease the dielectric strength around the source side terminal 30. Finally, since the gas exhaust passage 50 is integrally formed in the bottom wall 16 and there are no joints in the passage, and the electric insulation between the interior and the exterior of the passage is high.

Figure 2:
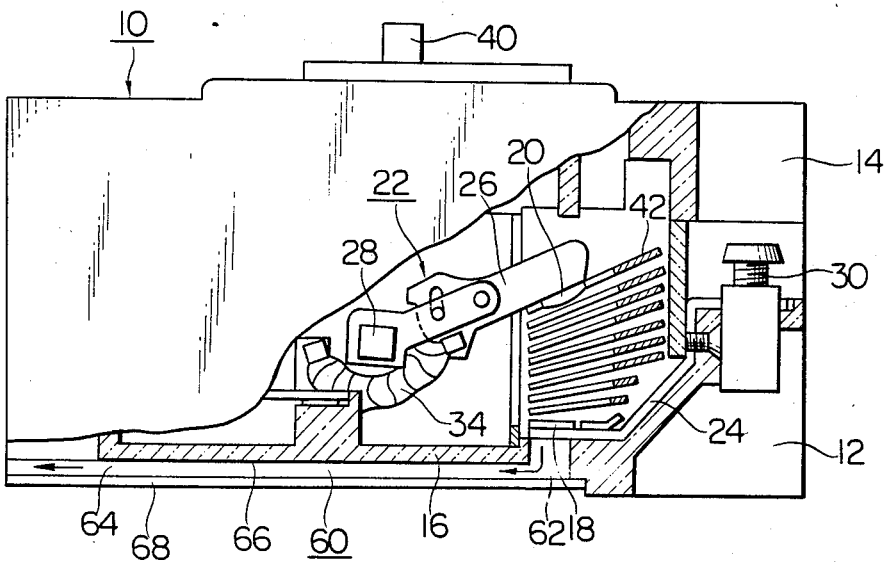
FIGS. 2 to 5 are views similar to FIG. 1 illustrating other embodiments of the present invention.

FIG. 2 shows another embodiment of the circuit interrupter of the present invention in which the arced gas exhaust passages 60 are provided in the bottom wall 16 that comprises inlet openings 62, outlet openings 64, grooves or channels 66 formed in the bottom surface of the bottom wall 16 and a back plate 68 secured by any suitable joining means such as an electrically insulating glue on the bottom surface of the bottom wall 16 to define gas exhaust passages 60 between the inner surface of the grooves 66 and the upper surface of the back plate 68. In other respects, the structure is the same as that previously described in conjunction with FIG. 1. With this arrangement, the gas exhaust passage 60 can be easily formed in the bottom wall 16 and the molding dies can also be simple.

Figure 3:
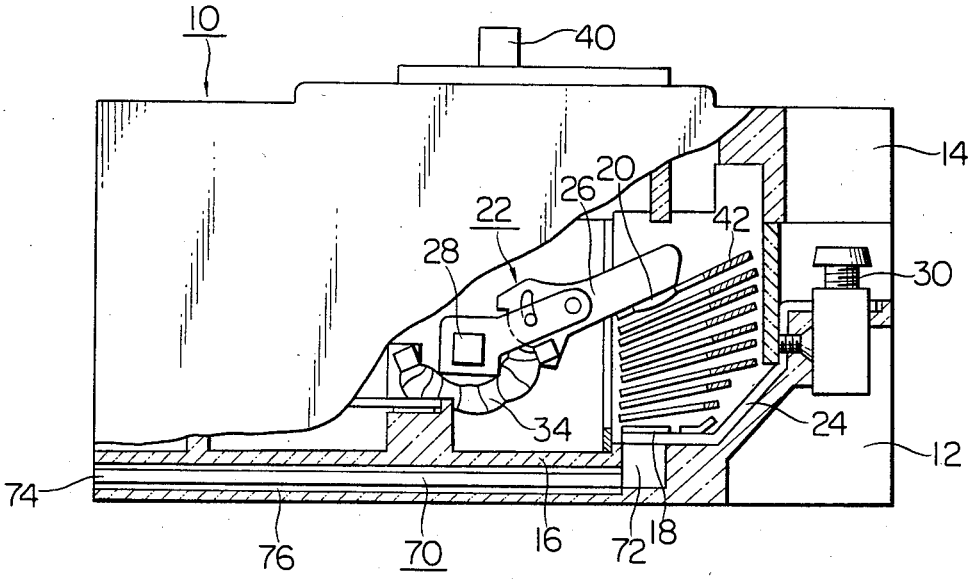

FIG. 3 shows another embodiment of the circuit interrupter of the present invention in which the arced gas exhaust passages 70 each having inlet openings 72 and outlet openings 74 and are defined by an electrically insulating hollow tube 76 embedded within the bottom wall 16 of the housing 10. This arrangement is easy to manufacture.

Figure 4:
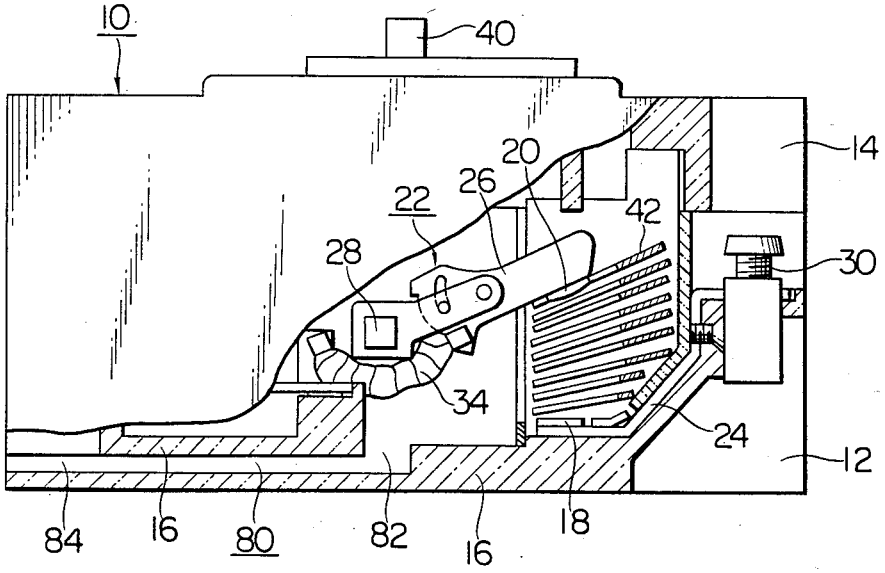

FIG. 4 shows another embodiment of the circuit interrupter of the present invention in which the arced gas exhaust passages 80 having inlet openings 82 and outlet openings 84 have the same structure as the gas passages 50 shown in FIG. 1, but is different from the passage 50 in that the former's inlet openings 82 are located closer to the electromagnetic and the bimetallic trip devices 36 and 38 and just below the cross bar 28. According to this arrangement, the metallic particles or vapors entrained in the arced gas that tend to drift toward the trip devices 36 and 38 and deposit thereon are suctioned into the inlet openings 82 to be exhausted through the passage 80.

Figure 5:
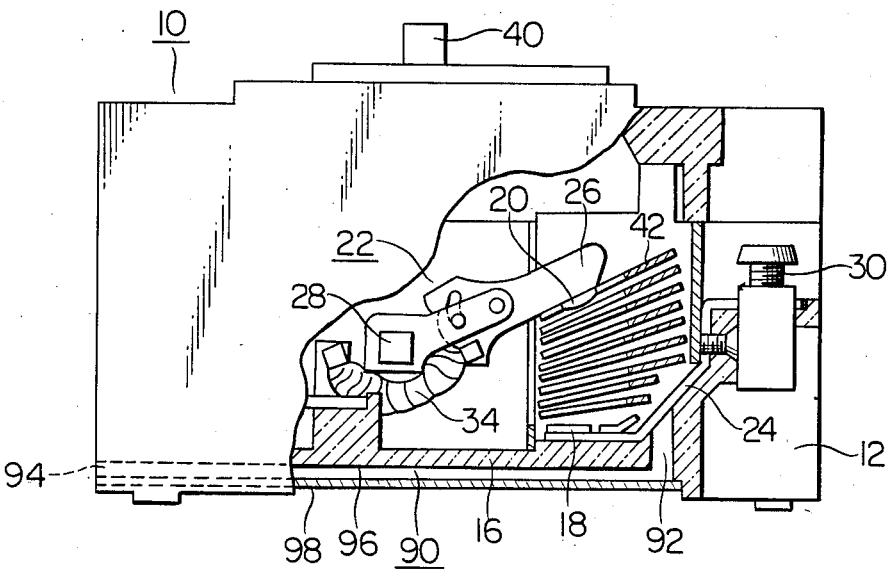
Figure 6:
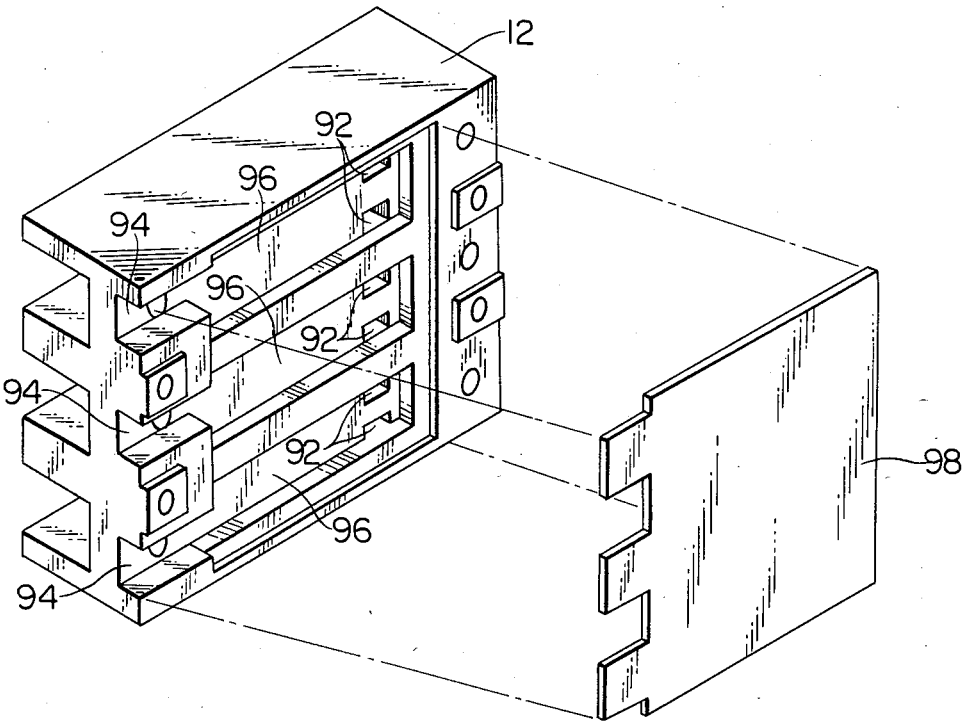
FIG. 6 is an exploded perspective view showing the structure of the gas exhaust passage shown in FIG. 5.

FIGS. 5 and 6 show another embodiment of the circuit interrupter of the present invention in which the arced gas exhaust passages 90 have inlet openings 92 and outlet openings 94, and are defined between grooves 96 and a back plate 98 similarly to the gas exhaust passages 60 shown in FIG. 2. It is seen that the passages 90 are different from the passages 60 in that the inlet openings 92 of the passages 90 are located behind the arc extinguisher 42 as viewed from the arcing region or at the position opposite from the contact pair 18 and 20 with respect to the arc extinguisher 42. With this arrangement, since the arced gas receiving inlet openings 92 are located on the opposite side of the arc extinguisher 42 with respect to the arcing region, the electric arc generated between the separated contacts 18 and 20 is forced to pass through the arc extinguisher 42 before the arc is received by the inlet openings 92 of the gas exhaust passage 90.

Figure 7:
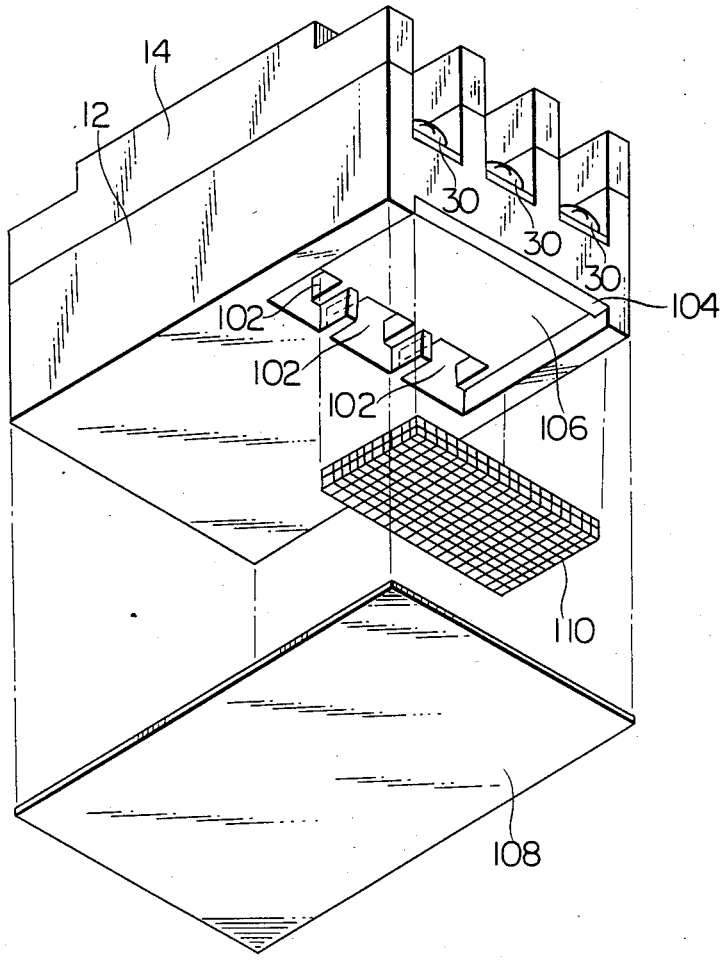
FIG. 7 is a perspective view showing a modified structure for the gas exhaust passage of the present invention.

FIG. 7 illustrates another circuit interrupter comprising a single gas exhaust passage 100 that has three inlet openings 102 and a single outlet opening 104 defined between a relatively wide channel 106 and a back plate 108. It is seen that a filter 110 is disposed within the gas exhaust passage 100. With this arrangement, since the gas exhaust passage 100 is not partitioned for each pole unit as those previously described, even when a high pressure, high temperature arced gas is generated in one pole unit and introduced into the passage 100 through one of the inlet openings 102 corresponding to the pole unit that has generated the electric arc, the high pressure arced gas is pressure-reduced in the relatively wide passage 100 and there is no risk of breakage of the partition walls due to a massive pressure differential. Also, since the filter 110 is disposed within the gas exhaust passage 100, any foreign matter is prevented from entering into the circuit interruter.

Figure 8:
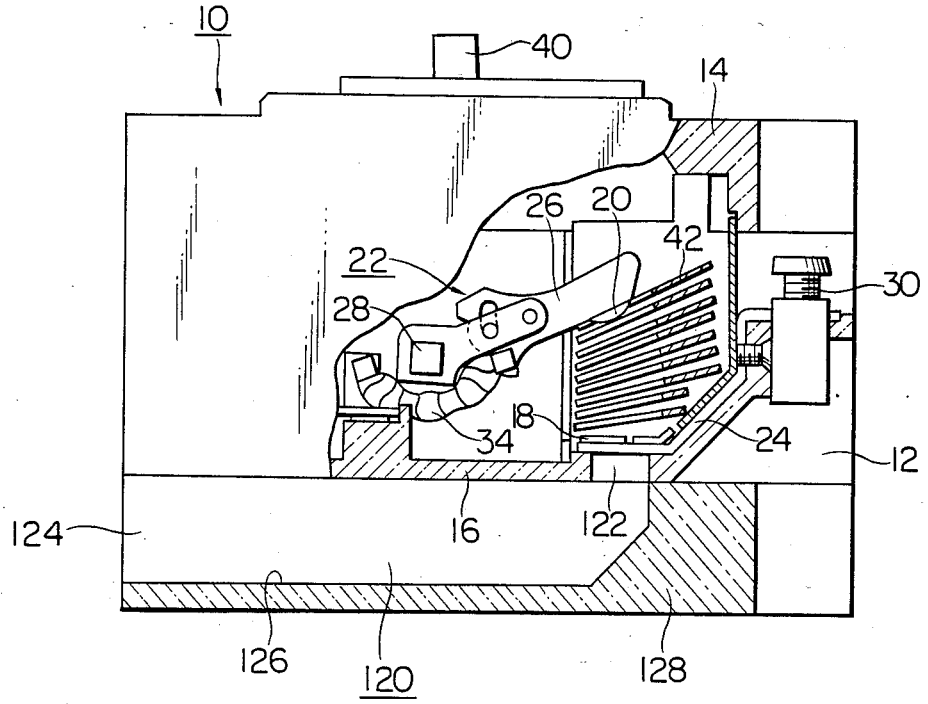
FIG. 8 is a sectional side view of a circuit interrupter of the present invention.
Figure 9:
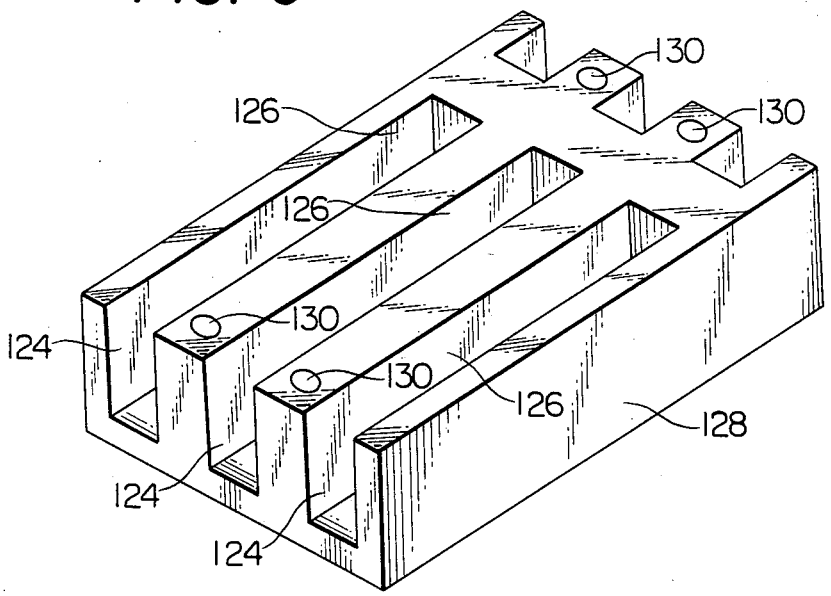
FIG. 9 is a perspective view illustrating the channel block shown in FIG. 9.

FIGS. 8 and 9 show another embodiment of the present invention, in which a gas exhaust passage 120 is defined between the bottom surface of the bottom wall 16 of the housing main body 12 in which a plurality of inlet openings 122 are formed and a plurality of channels 126 having outlet openings 124 formed in a relatively thick channel block 128 having a predetermined thickness. The channel block 128 may be secured to the bottom surface of the housing main body 12 by a set of screws (not shown) that extend through the holes 130 formed in the channel block 128 and threaded into the housing main body 12. With this arrangement, the overall height of the circuit interrupter can readily be changed by the replacement of the channel block 128 with another block that has a different thickness. This feature is particularly useful when a plurality of circuit interrupters or other electrical devices of differing thicknesses or heights are installed on a switch panel because it is very easy to align the top surfaces of the devices.

Figure 10:
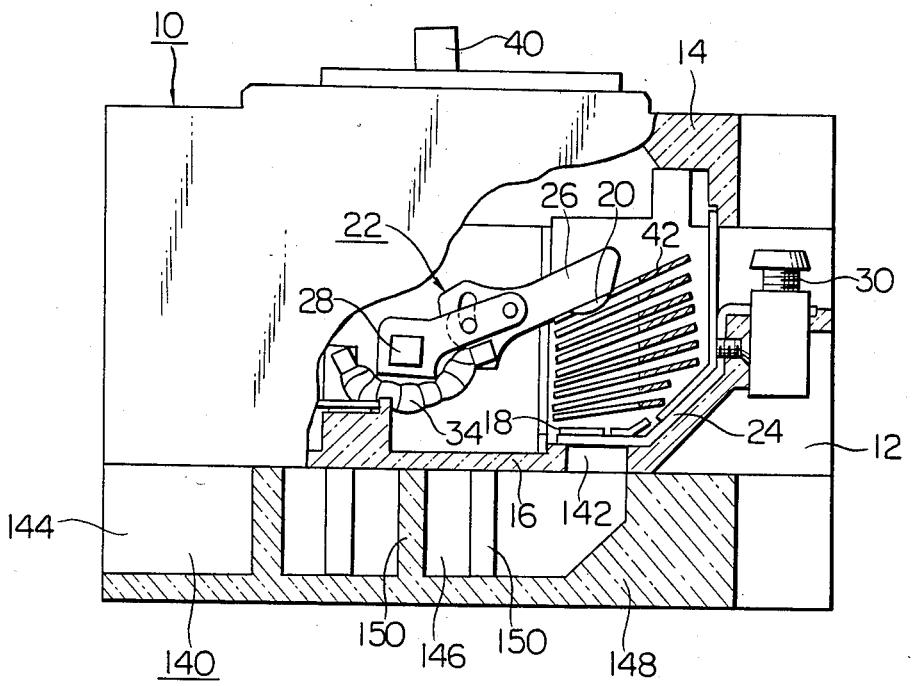
FIG. 10 is sectional side view of a circuit interrupter of the present invention.
Figure 11:
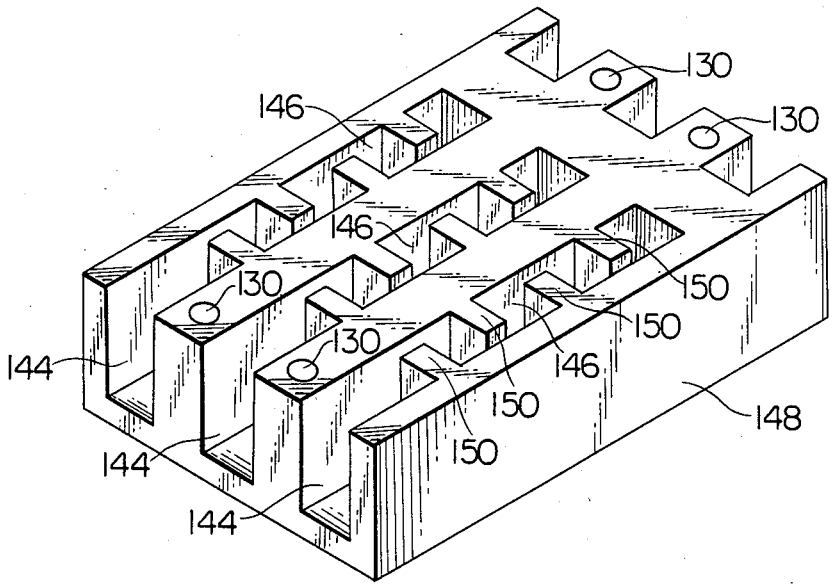
FIG. 11 is a perspective view illustrating the channel block shown in FIG. 10.

FIGS. 10 and 11 illustrate a modification of the circuit interrupter shown in FIGS. 8 and 9. As apparent, the circuit interrupter is provided with a plurality of arced gas passages 140 having inlet openings 142 and outlet openings 144 defined between the bottom wall 16 of the housing main body 12, and winding channels 146 formed in a channel block 148. This arrangement is different from that shown in FIGS. 8 and 9 only in the winding shape of the channels 146, which is defined by a plurality of alternately projecting short walls 150. In other respect, the arrangement is the same as that shown in FIGS. 8 and 9. With this arrangement, since the gas exhaust passages 140 are winding in a serpentine manner, the exhausted gas at the outlet openings 144 can be sufficiently cooled before it is exhausted from the passages 140 and a higher dielectric strength between the inlet and the outlet openings 142 and 144 is obtained. Also, entry of any foreign matters into the circuit interrupter through the gas exhaust passages 140 is prevented.

What is claimed is:

1. A circuit interrupter comprising;

a pair of separable contacts defining, when separated, an arcing region therebetween;

an operating mechanism for opening and closing said separable contacts; and a housing enclosing said separable contacts and said operating mechanism, said housing having an electrically insulating housing bottom wall and having a gas exhaust passage disposed in said housing bottom wall;

said gas exhaust passage having an inlet opening located in said housing bottom wall in a position effective for exhausting an arced gas generated in the arcing region without the arced gas contacting the operating mechanism, said housing bottom wall comprising a bottom wall defining the inner surface of the housing bottom wall, and a channel block attached to said bottom wall and defining the outer surface of the housing bottom wall, said gas exhaust passage being formed between said bottom wall and said channel block.

2. A circuit interrupter as claimed in claim 1, wherein said inlet opening of said gas exhaust passage is disposed directly facing and close to said arcing region.

3. A circuit interrupter as claimed in claim 1, wherein said inlet opening of said gas exhaust passage is disposed on the opposite side of an arc extinguisher with respect to said arcing region.

4. A circuit interrupter as claimed in claim 1, wherein said outlet opening of said gas exhaust passage opens on the load terminal side of the circuit interrupter.

5. A circuit interrupter as claimed in claim 1, wherein said gas exhaust passage extends in a serpentine manner.

6. A circuit interrupter as claimed in claim 1, wherein said gas exhaust passage has a plurality of inlet openings.

7. A circuit interrupter as claimed in claim 1, further comprising a filter placed in said gas exhaust passage.

* * * * *